US007395583B2

(12) United States Patent
Clune et al.

(10) Patent No.: US 7,395,583 B2
(45) Date of Patent: Jul. 8, 2008

(54) HOOK ENGAGEABLE LOOPS

(75) Inventors: William P. Clune, Northwood, NH (US); William H. Shepard, Amherst, NH (US); George A. Provost, Litchfield, NH (US)

(73) Assignee: Valero Industries B.V., Curacao (NL)

( * ) Notice: Subject to any disclaimer, the term of this patent is extended or adjusted under 35 U.S.C. 154(b) by 56 days.

(21) Appl. No.: 10/300,532

(22) Filed: Nov. 20, 2002

(65) Prior Publication Data

US 2003/0084553 A1 May 8, 2003

Related U.S. Application Data

(63) Continuation of application No. PCT/US01/17220, filed on May 25, 2001.

(60) Provisional application No. 60/207,516, filed on May 26, 2000.

(51) Int. Cl.
*A44B 18/00* (2006.01)

(52) U.S. Cl. ..... 24/451; 24/442; 428/100

(58) Field of Classification Search ..... 24/447, 24/449, 446, 445, 444, 442, 304, 450, 451, 24/452; 428/100, 99, 85, 156
See application file for complete search history.

(56) References Cited

U.S. PATENT DOCUMENTS

| | | | | |
|---|---|---|---|---|
| 3,230,134 | A | | 1/1966 | Studer |
| 3,267,191 | A | | 8/1966 | Williams et al. |
| 3,312,583 | A | | 4/1967 | Rochlis |
| 3,445,915 | A | | 5/1969 | Cuckson et al. |
| 3,462,332 | A | | 8/1969 | Goto |
| 3,594,863 | A | | 7/1971 | Erb ..... 18/5 |
| 3,594,865 | A | | 7/1971 | Erb ..... 18/5 |
| 3,600,766 | A | | 8/1971 | Alberts ..... 24/205.12 |
| 3,608,035 | A | | 9/1971 | Fröhlich ..... 264/146 |
| 3,726,752 | A | | 4/1973 | Provost ..... 161/67 |
| 3,758,657 | A | | 9/1973 | Menzin et al. ..... 264/166 |
| 3,843,760 | A | | 10/1974 | Teed ..... 264/171 |
| 3,863,304 | A | * | 2/1975 | Brumlik ..... 24/445 |
| 3,956,056 | A | | 5/1976 | Boguslawski et al. ..... 156/500 |
| 3,983,278 | A | | 9/1976 | Wardle ..... 428/92 |
| 4,097,634 | A | | 6/1978 | Bergh ..... 428/156 |
| 4,329,196 | A | | 5/1982 | Rawlinson ..... 156/243 |
| 4,451,421 | A | | 5/1984 | Jones et al. ..... 264/167 |
| 4,725,473 | A | * | 2/1988 | Van Gompel et al. ..... 428/156 |
| 4,726,975 | A | | 2/1988 | Hatch ..... 428/100 |
| 4,761,318 | A | * | 8/1988 | Ott et al. ..... 428/85 |
| 4,784,890 | A | | 11/1988 | Black ..... 428/100 |
| 4,794,028 | A | | 12/1988 | Fischer ..... 428/100 |

(Continued)

FOREIGN PATENT DOCUMENTS

CN 1286571 A 3/2001

(Continued)

OTHER PUBLICATIONS

Communication dated Dec. 31, 2004 from corresponding Chinese application No. 01811777.5 (translation included).

*Primary Examiner*—Jack W. Lavinder
(74) *Attorney, Agent, or Firm*—Fish & Richardson P.C.

(57) ABSTRACT

Hook-engageable loop materials are provided, which include high bulk yarns. Closure strips employing such materials, and methods of making such materials are also provided.

20 Claims, 16 Drawing Sheets

U.S. PATENT DOCUMENTS

| | | | | | |
|---|---|---|---|---|---|
| 4,872,243 | A | | 10/1989 | Fischer | 24/442 |
| 4,931,344 | A | | 6/1990 | Ogawa et al. | 428/100 |
| 4,933,224 | A | | 6/1990 | Hatch | 428/100 |
| 4,999,067 | A | | 3/1991 | Erb et al. | 156/73.1 |
| 5,171,341 | A | * | 12/1992 | Merry | 55/484 |
| 5,260,015 | A | | 11/1993 | Kennedy et al. | 264/167 |
| 5,441,687 | A | | 8/1995 | Murasaki et al. | 264/167 |
| 5,512,234 | A | | 4/1996 | Takizawa et al. | 264/511 |
| 5,620,769 | A | | 4/1997 | Wessels et al. | 428/100 |
| 5,669,120 | A | | 9/1997 | Wessels et al. | 24/446 |
| 5,699,593 | A | * | 12/1997 | Jackson | 24/445 |
| 5,702,797 | A | | 12/1997 | Sakakibara et al. | 428/100 |
| 5,744,080 | A | | 4/1998 | Kennedy et al. | 264/167 |
| 5,843,158 | A | * | 12/1998 | Lenker et al. | 623/1.13 |
| 5,974,635 | A | * | 11/1999 | Murasaki | 24/446 |
| 5,981,027 | A | | 11/1999 | Parellada | |
| 5,997,981 | A | * | 12/1999 | McCormack et al. | 24/448 |
| 6,060,146 | A | | 5/2000 | Akeno et al. | 428/100 |
| 6,202,260 | B1 | * | 3/2001 | Clune et al. | 24/446 |
| 6,332,250 | B1 | * | 12/2001 | Igaue et al. | 24/445 |
| 6,463,635 | B2 | | 10/2002 | Murasaki | 24/452 |
| 6,589,638 | B1 | * | 7/2003 | McCormack et al. | 428/198 |
| 6,604,264 | B1 | | 8/2003 | Naohara et al. | 24/444 |

FOREIGN PATENT DOCUMENTS

| | | | |
|---|---|---|---|
| DE | 1937746 | | 2/1970 |
| DE | 2017522 | | 12/1971 |
| DE | 2109652 | | 9/1972 |
| EP | 0 580 073 | A2 | 1/1994 |
| EP | 0 882 828 | A1 | 12/1998 |
| EP | 0 895 731 | A2 | 2/1999 |
| EP | 1 078 582 | A1 | 2/2001 |
| FR | 2082591 | | 12/1971 |
| FR | 2348801 | | 11/1977 |
| FR | 2364004 | | 4/1978 |

* cited by examiner

HOOK ENGAGEABLE LOOPS

CROSS-REFERENCE TO RELATED APPLICATIONS

This application is a continuation of PCT/US01/17220, filed May 25, 2001, and also claims priority from U.S. Provisional 60/207,516, filed May 26, 2000.

BACKGROUND

This invention relates generally to touch fasteners and engageable loop members for such fasteners, and more particularly to their application in products such as closure strips for bags and flexible packaging, and to methods and apparatus for their manufacture.

For many disposable packaging applications, low-cost flexible closures are needed. Some reclosable commercial closures used for bags and the like feature interengaged profile zipper seal technology. Other closures, both single-use and reclosable, can feature various adhesives, twist ties, clip strips or drawstrings. Hook-and-loop closure technology has also been suggested for closures for packaging, such as flexible bags, but to date has not been widely employed.

Some of the ideal qualities of many high volume, disposable packaging closures include low stiffness, low weight, low bulk and low cost. In many cases, repeated opening and closing is required, but for many disposable applications the anticipated number of repetitive openings and closings of each product is only on the order of two to ten.

SUMMARY

We have realized that for many packaging applications for which hook-and-loop closure technology has generally been considered too bulky or too expensive for practical use, the closure can be arranged such that the hook-and-loop fastening itself is predominantly loaded in shear. Examples include envelope-type and rolled top bag closures, wrap ties, and inner bag face closures incorporating peel-avoiding features. Furthermore, we have realized that for many of these applications, minimal closure strength is required to maintain the opening of the bag or packaging adequately closed against anticipated loads.

Examples of some of the closure configurations and packaging applications to which this invention is directed and is particularly useful are found in our co-pending U.S. patent application Ser. Nos. 09/187,389, 09/187,936, 09/133,991, provisional U.S. patent application No. 60/159,489, and PCT application US99/26261, filed designating the United States. All of the disclosure of these applications is hereby incorporated by reference.

With improvements that have occurred over the years in the processes for inexpensively producing very small, molded male fastener elements, such as by the continuous molding methods taught by Fisher (in U.S. Pat. No. 4,794,028, hereby incorporated by reference as if fully set forth), the cost of the loop component of such touch closures has, for many applications, been the limiting factor for the applicability of touch fastener technology.

We have now found that some commercially available, mass-produced yarns sold for use in, for example, home crafts such as knitting or embroidery, or for use in the production of carpets, can, in conjunction with certain parameters and features, form the basis for inexpensive, effective loop components for hook and loop closure systems. In particular such a loop closure employed in packaging configurations of types constructed to apply loading to the fastener mostly in shear, with low peel loading, is found to provide a low-cost solution for many disposable packaging needs.

In particular, according to one aspect of the invention, it is discovered that a high bulk yarn, for instance a yarn comprised of multiple, twisted-together plies each formed of fibers or filaments that have been either individually crimped or otherwise textured, can serve admirably to provide a low-cost, hook-engageable component for a hook and loop fastener for flexible disposable packaging such as bags and envelopes. By "bulk" as applied to yarn, we refer to the ratio of area within a cross-section of the yarn occupied by the fibers. In other words, we define a "bulk ratio" as the cross-sectional area of the twisted fiber, determined by the diameter as measured across the twisted plies but ignoring extraneous, loose fiber ends, divided by the fiber area. For yarns consisting of fairly uniform fibers, the fiber area is the cross-sectional area of a single representative fiber, as determined by its nominal diameter, times the total number of fibers in the yarn. We prefer a yarn with a bulk ratio, at rest before lamination, of between about 15 to 50, more preferably between about 18 and 40, and most preferably between about 20 and 25.

It is generally preferred that the area of the surface of the carrier to which the yarn is applied be substantially planar. By "substantially planar", we mean that, while the surface may not be completely flat, the surface does not include any continuous raised structures, such as ribs. Other areas of the carrier, spaced from the area to which the yarn is applied, may include hooks or other raised features. Including continuous raised structures will tend to make the fastener material stiffer, and may increase the thickness of the fastener material, which may be undesirable in some applications. It is generally preferred that the carrier sheet be relatively thin, e.g., less than about 0.010 inch, more preferably from about 0.005 to 0.007 inch. Moreover, raised structures may make it impractical to apply the fastener material as a bag closure, due to difficulties in forming a bag side seal around a relatively thick closure strip. In some applications, e.g., when a very thin fastener material is required, it may be desirable for the surface to which the yarn is applied to be free of any raised structures, including discontinuous structures such as posts.

For some closures, the yarn is partially encapsulated in the surface resin of a closure strip on which an array of molded male fastener elements are integrally formed, such that when the closure is closed the male fastener elements engage and retain unencapsulated, lofty segments of individual fibers or filaments of the yarn. In such closures the yarn is preferably permanently encapsulated in the closure strip continuously along the length of the yarn to anchor the yarn firmly against being pulled from the encapsulating resin during loading or opening. The yarn may be laid longitudinally straight along the closure in the machine direction of manufacture, or in a reciprocating pattern to form a broad loop region of the closure. In some cases, the yarn extends across the loop region of the closure, transverse to the machine direction and length of the closure strip and the molded array of fastener elements.

The encapsulated fibers of the yarn preferably are of a material having a higher melting point than that of the encapsulating resin, such that the fibers may be encapsulated in the resin without losing their integrity as fibers or being melted into the base resin. Preferred base resin materials will be compatible with the resin of the packaging to which they are to be applied and include polyethylene, polypropylene, nylon, PVC and other thermoplastics. Preferred yarn materials include acrylic and nylon (such as those of, for example, knitting yarns for sweaters and such), polyester, polypropylene, natural fibers such as cotton or wool, and bulk continuous fiber yarns used for carpets and such.

We have found that such yarns can be effectively and inexpensively encapsulated in a resin base under conditions selected to cause only fiber segments on a near side of the yarn to become encapsulated by the resin, leaving the fiber segments on a far side of the yarn in a lofty condition, exposed for engagement by male fastener elements. We have found that, without any post-processing of the yarn fibers or base resin (i.e., as encapsulated), the yarns of such loop products can provide sufficient engagement with suitable male fastener elements to function as reclosable closures for many disposable packaging applications. The encapsulation may be accomplished, for instance, by employing a cooled roll, preferably in a calendar stack, which receives the yarn and the resin with at least one molten surface.

It has also been found that inexpensive, high loft yarns may be suitably encapsulated in base resin of a closure strip by introducing the yarn directly into the fastener element forming nip of the device taught by Fisher, under nip pressures high enough to force the resin into fastener element cavities, while leaving a sufficient number of fibers of the yarn unencapsulated, exposed and of sufficient loft to define hook-engageable loops. As the yarn is not to provide any structural strength or stiffness to the base of the closure, only enough fibers of the yarn need be encapsulated to resist anticipated pull-out forces at every point along its length. It is found, for example, that with polyethylene as a base resin, extruded into the forming station at temperature above 400 degrees Fahrenheit, a high bulk, twisted, multi-ply, acrylic knitting yarn survives the process conditions, only yarns at one side being matted and encapsulated by the base-forming resin, while the fibers at the opposite side, held adjacent a cold roll during the process, survive intact and spring back after processing to a high bulk condition. Because of the twisting of the plies about each other, a significant number of the exposed fiber segments are at most only as long as a partial revolution of one ply twist, secured at each end in the base resin and thus effectively defining hook-engageable fibers anchored to the base. In other words, the high effective twist of the filaments can create hook-engageable loop segments of less than about ¼ inch in length.

By appropriately controlling the forming speed and resin temperature and pressure (the optimal values of which are interdependent and will depend on the type of resin employed and the geometry of the product, as will be understood by those of normal skill in the art), the resulting penetration of substrate resin into the loop material may be controlled so as to not completely flood the exposed surface of loops with resin. In many applications, the use of appropriately contoured staking rings to force the yarn into the molten resin can help to form a pattern of lofted regions of yarn that are less penetrated by resin than other areas. Such lofted regions can extend even more loops for ready engagement by fastener elements.

It is also found that such partially-encapsulated, twisted multi-ply fibers can provide good fiber density for accepting very small male fastener elements, such as hooks of height of 0.015 inch or less, arranged in arrays with a density of between about 500 and 3000 fastener elements per square inch. It has been found that sufficient open space is created between filaments of the exposed segments of each ply, as well as interstices between the twisted plies, to allow for effective penetration by the fastener elements to achieve effective reclosable hook and loop engagement for disposable packaging applications.

As used in this specification, the general term "hook-engageable" as applied to loops means loops that can be engaged by hooks of one of the various available types, such as J-hooks, palm trees and mushrooms.

The details of one or more embodiments of the invention are set forth in the accompanying drawings and the description below. Other features, objects, and advantages of the invention will be apparent from the description and drawings, and from the claims.

DESCRIPTION OF THE DRAWINGS

Like reference numbers and designations in the various drawings indicate like elements.

DETAILED DESCRIPTION

Figure 1:
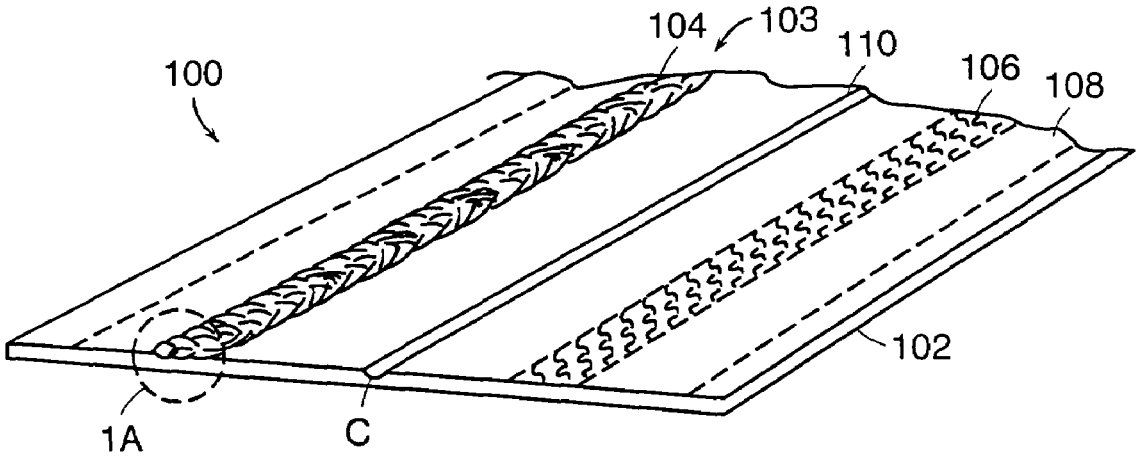
FIG. 1 is a perspective view of a composite touch fastener in the form of a closure strip.

Referring to FIG. 1, a lengthwise-continuous closure strip 100, such as for sealing a bag, consists of a thin, sheet-form resin substrate 102 with lengthwise-continuous, parallel bands 103 and 106 of loops and fastener elements, respectively, on its front face 108. Bands 103 and 106 are equally spaced from the center "C" of the closure strip, such that when the strip is folded longitudinally at "C" to cover front face 108, the fastener elements of band 106 engage and retain the loops of band 103 to form a releasable fastening. The fastener elements 110 of band 106 are integrally molded with and extend from front face 108. In this embodiment, these fastener elements are in the form of J-hooks that extend, in rows, along the length of the closure strip. Some of the J-hooks face in opposite directions along the strip. Other fastener element shapes may also be employed, including other types of hooks, and fastener elements that overhang the substrate 102 in a widthwise direction. A suitable fastener element shape is the CFM29 hook shape (of about 0.015 inch in height), available in various products sold by Velcro USA, Manchester, N.H.

Band 103 of loops consists of a single strand of yarn 104 having four plies twisted about each other in helical form, such that fibers of each of the four plies extend both into the resin of the base and away from the resin to form engageable loops. Alternatively, band 103 may consist of two parallel strands of yarn (not shown) extending along the closure strip and separated by a small distance. Other arrangements are discussed more fully below. In one present example the band 106 of hooks is about 0.375 inch wide, and the band 103 of loops is about 0.125 inch wide and consists of two parallel strands of yarn laid against one another.

Figure 1A:
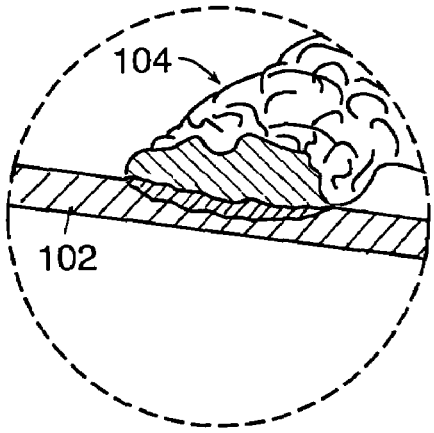
FIG. 1A is an enlarged view of area 1A in FIG. 1, showing the structure of the loop component of the closure strip.
Figure 1B:
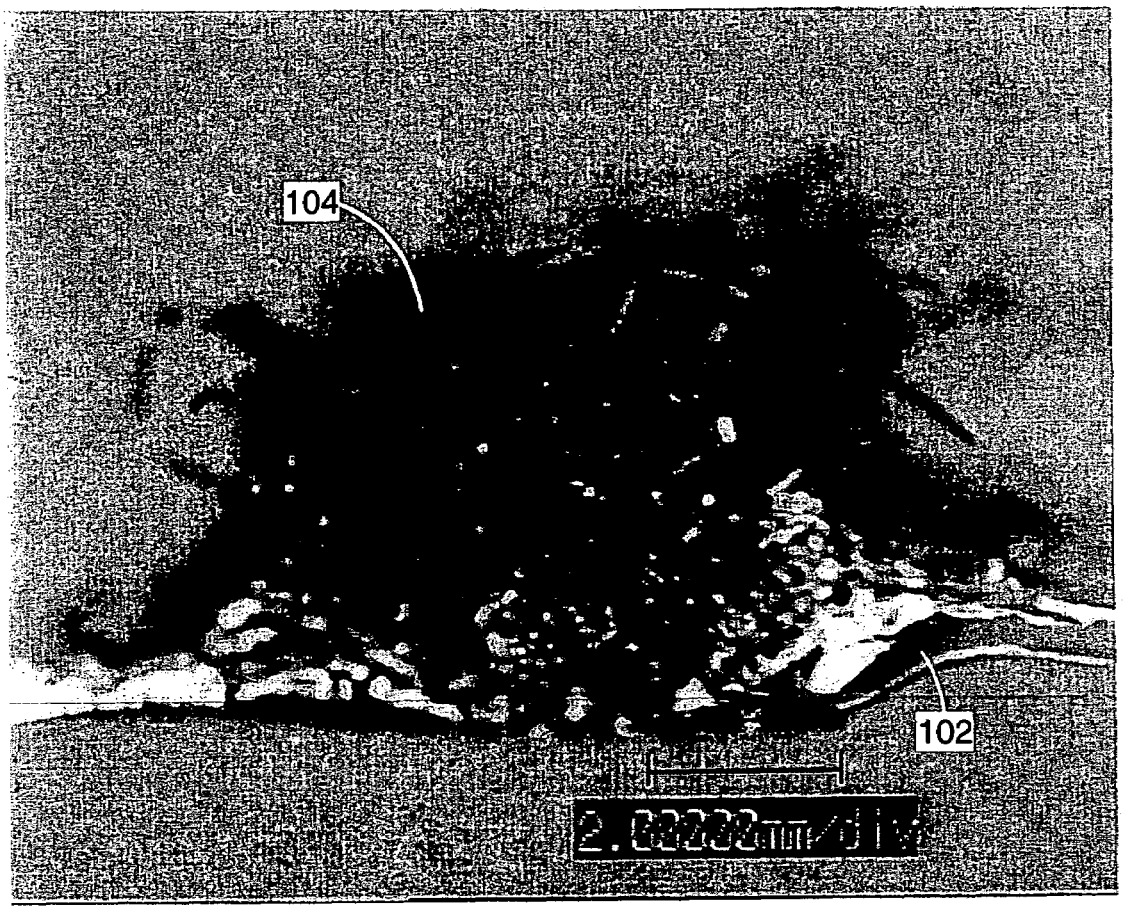
FIG. 1B is a microphotograph of a cross-sectioned loop component.

As illustrated in FIG. 1A and shown in FIG. 1B, fibers of yarn 104 are, along the underside of the yarn, encapsulated directly in resin of the substrate as the substrate is formed in a continuous molding process (described below). In other cases, the yarn is continuously bonded to the formed substrate, either by ultrasonic bonding, welding, or adhesives. As can be seen in FIG. 1B, the strand of yarn is quite thick as compared to the thin base, and the resin of the base penetrates only the near portion of the yarn.

Figure 1C:
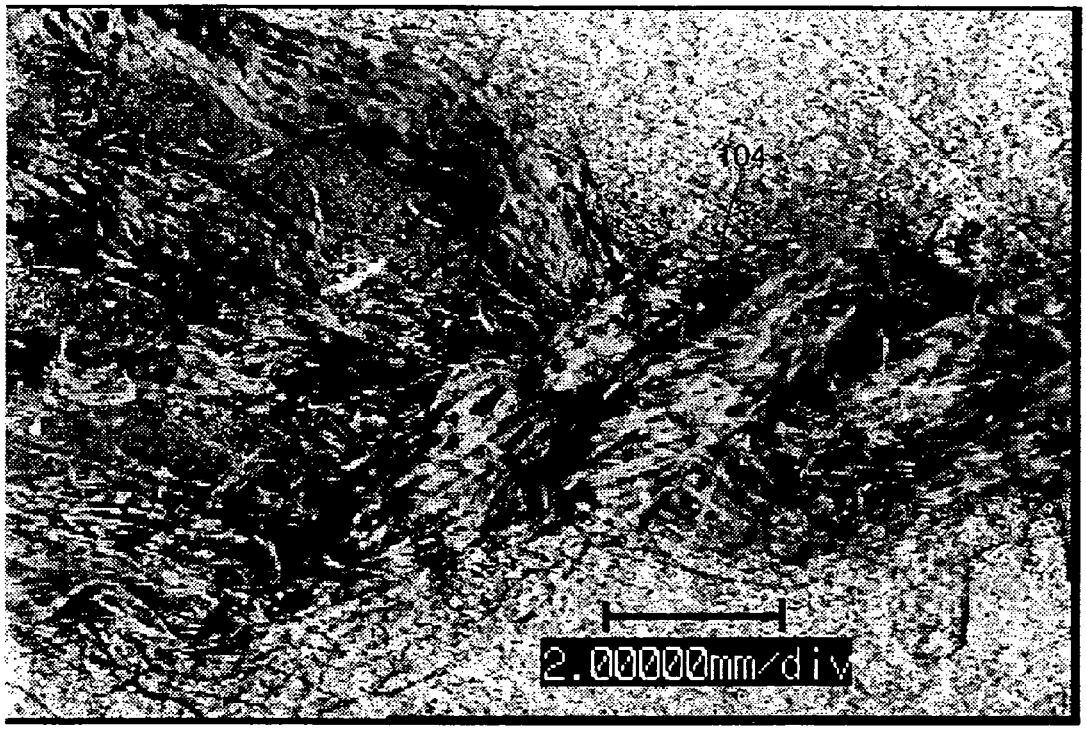
FIG. 1C is a microphotograph of a four-ply yarn loop component, partially untwisted.
Figure 1D:
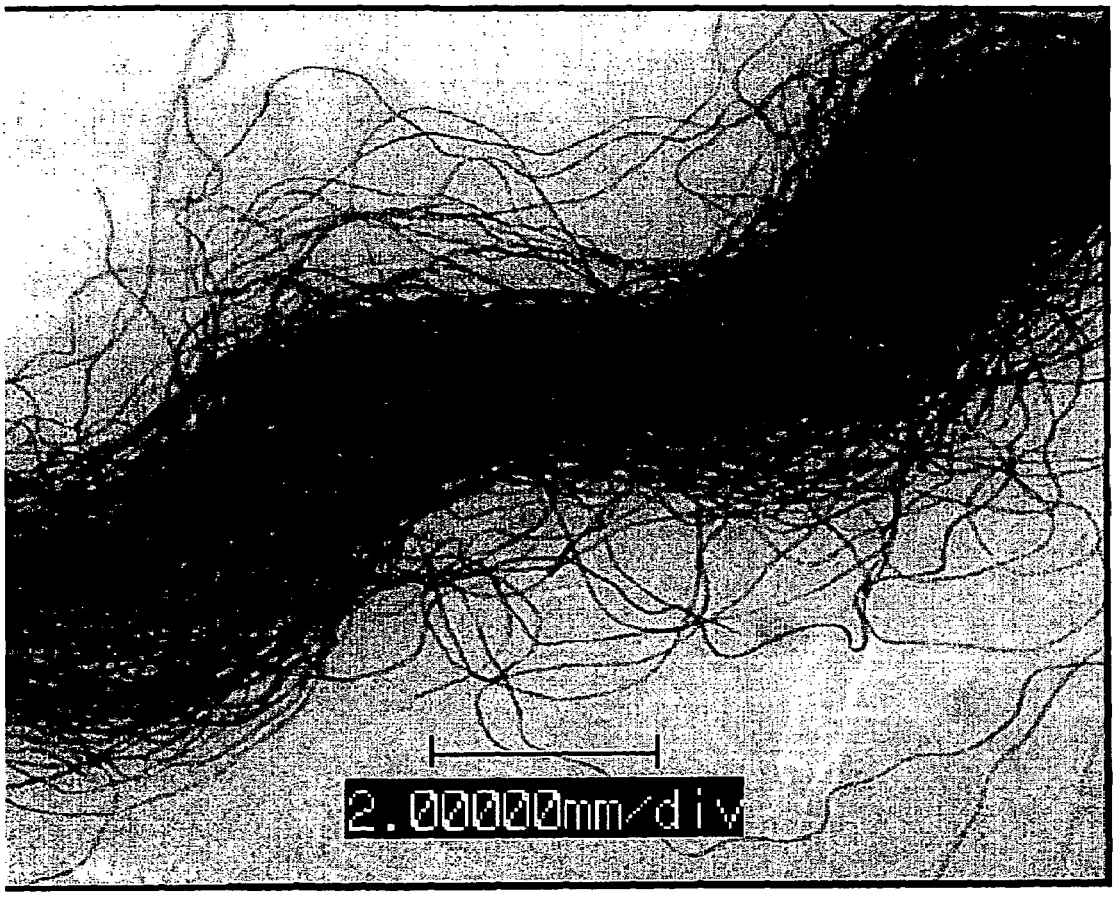
FIG. 1D is a microphotograph of one of the plies of the yarn strand of FIG. 1C, removed from the strand.

FIG. 1C shows the four-ply strand of yarn used in the closure of FIG. 1, with the four individual plies unraveled in the left half of the photograph. As may be seen in the photograph, each ply consists of many individual fibers or filaments that, rather than being perfectly straight and smooth, are locally bent and kinked so as to provide high loft in the yarn strand. In this sense the yarn fibers are 'texturized' by crimping or other methods known in the yarn art. In the example shown, individual acrylic fibers or filaments have a diameter of about 0.00088 inch and are of a denier of about 2, and there are about 200 filaments in each of the four plies. The twisting of the plies about one another is evident in the right half of the photograph. Within each ply there is also some twist of the fibers, and the twisting of the plies together creates a 'set' in each ply corresponding to the pattern of the twist, as visible in the photograph in FIG. 1D of a single ply untwisted from the yarn. One of the reasons this twisted yarn structure has been found to work well as a hook-engageable loop is because individual fibers typically rotate from front to back (i.e., about the yarn strand) over a very short distance, and the axial pitch or distance between adjacent plies, along the outer surface of the yarn, is only about 0.040 inch. By securing one side of the yarn continuously along its length to a base carrier, both ends of the exposed, free partial turns of the yarn are anchored to the carrier. This gives very good anchoring, allowing hooks to snag these fibers but providing good retention against pulling the fibers away from the carrier. An effective pitch in the twist of a fiber of about 0.040 inch in this illustrated example means that at about every 1/16 inch along the fiber, a ply of the fiber is anchored at both sides, thereby creating loops exposed to be engaged by hooks at fairly repetitive 1/16 inch intervals.

Figure 1E:
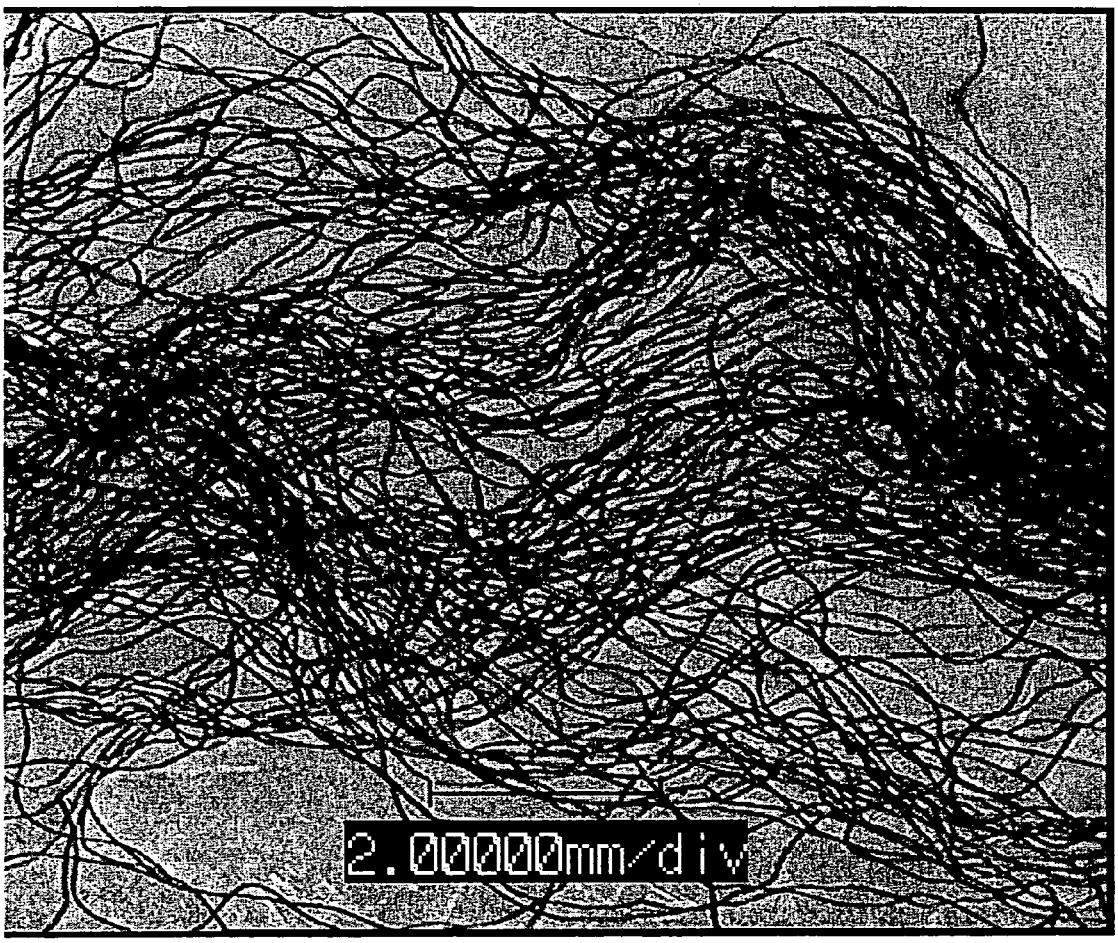
FIG. 1E is a microphotograph of many of the individual filaments making up one ply of the yarn loop component.

The bulkiness or loft of the yarn resulting from the mechanical interference of the kinks and bends of the crimped filaments is particularly related to the ability of the yarn to successfully encounter and engage mating hooks of a given size and shape. The crimped or textured nature of the individual fibers is visible in FIGS. 1D and 1E, for example. We believe that, although the overall engagement performance of an array of male fastener elements with a field of fibrous loops is a statistical consideration, the basic mechanics of the engagement can be described with respect to a single hook-type fastener element. When a hook of re-entrant shape (e.g., a J-type hook with a tip that curves back toward the base) enters a loop field, the head of the hook will likely encounter and push aside one or more loops or fibers as the hook mass penetrates the loop material. In some cases, a fiber will spring back into the crook of the hook when the hook has sufficiently penetrated the bulk of fibers, such that pulling the hook straight back out of the loop material will engage the fiber. In other cases, slight lateral movement of the hook with respect to the fibers places one or more fibers within the crook of the hook. We can say that at the point when a loop or fiber extends under the overhanging portion of the hook, the hook and loop are 'committed' although not yet 'engaged.' Given that engageable fibers are rarely taut, as a committed hook is pulled away from the loop material it is unable to carry any appreciable load when the surface of the hook first comes into contact with the committed loop in its relaxed state. It is only after the free length of the loop or fiber is pulled taut that the individual loop and hook can resist separation load. Much of the technique of enhancing the performance of hook-and-loop type closures is improving the likelihood of commitment, which can be affected by the entrance footprint and shape of the head of the hook (which can affect the ability of the hook to successfully penetrate the loop material to a level below the level of some nearby fibers), the resiliency of the fibers, the structure of the tip of the hook (which can affect its ability to burrow between fibers), and the tendency toward lateral, commitment-enhancing motion. The latter is believed to be associated with the observation that hook-and-loop type fastenings perform much better in shear than under peel or normal loads, as shear causes a degree of lateral motion that develops new commitments and subsequent engagements even as other engagements are yielding. With respect to selecting the best twisted, multi-ply yarn as a loop component, hook penetration into the yarn mass is as much a function of the nature of the field of loop fibers as it is of the structure of the hook. As has been understood for some time, the best loop material is not necessarily the one with the densest population of loops. Without sufficient free space within the loop mat for the heads of the hooks to penetrate the fiber mass and laterally deflect loops, there is only weak fastening at best. We believe that this is why some bulk or loft of the loop mass is required for a yarn to be a successful candidate for a loop material. Some commercially available multi-ply yarns, even some with crimped or texturized fibers, are twisted quite tightly and thus are too dense to enable adequate hook-loop commitment. A twisted yarn that is too dense but otherwise has desirable properties as a loop component may be slightly untwisted as it is attached to the closure resin. We have found that, as well as decreasing the internal fiber density of the yarn to provide additional air volume for hook penetration and increasing the cross-sectional area of the yarn to spread the loon fibers over a wider width in the finished closure, untwisting a multi-ply yarn can also create a useful helical gap between adjacent plies that can increase the effective surface area of the yarn presenting loops for engagement.

We believe that acrylic knitting yarn fibers survive the pressure and temperature preferably employed to secure the yarn to the base, in part because of the bulk of the yarn, its thermal insulating effect, and the flow barrier effect such yarns create. We prefer to actively cool the surface of the tool (in preferred cases, a roll of the molding nip) that directly engages the yarn and forces it against the molten resin, to help inhibit complete encapsulation.

In the preferred case of using a calendaring process to join bases and yarns of dissimilar resins, the molten plastic is squeezed to a very thin cross section as it goes through the nip, and therefore has little thermal mass and cools as it contacts adjacent portions of the cooled forming roll, causing the viscosity of the base resin to rise. This, in combination with the fact that the chemical incompatibility does not permit wetting of the yarn fibers by the base resin, enables the fibers themselves to form such a flow barrier that the more remote fibers are not submerged in the resin and thus retain their loft and hook-engageable properties. Despite the base resin being very hot as it enters the nip, only the near side of the yarn that makes initial contact with the resin becomes embedded. The remainder of the yarn material springs back to recover some of its bulk after passing through the nip, placing a small amount of residual tension in some of the fibers with encapsulated sections. The retention of the yarn fibers in the base resin is enhanced by being of resin that has a higher melting temperature than that of the plastic forming the base, so that the exposed and encapsulated segments continue to form continuous filaments mechanically and sporadically anchored in the base resin. When embedding loop yarn in chemically incompatible base resin, in many cases the anchoring of the yarn is strictly mechanical. Acrylic fibers are not chemically compatible with polyethylene, for example. For many flexible packaging applications lineal low-density polyethylene is chosen for the carrier web, for ready heat sealing to standard polyethylene packaging film, or to sealant layers of multilayer films.

Besides the type of yarns commercially available in retail craft stores for knitting, crimped bulk continuous filament (BCF) yarn used in the manufacture of carpets, for instance, is also useful for some applications. Useful carpet yarn tends to be of a higher denier, on the order of about 5 to 20, for example, with individual fibers of between about 0.001 and 0.002 inch in diameter, while knitting yarns may be of a weight of about 2 to 5 denier with fibers of about 0.0006 to 0.001 inch in diameter. It is believed that, with sufficient resiliency and tenacity, the finer fibers are more readily adapted to mating with extremely small male fastener elements, such as those of a size similar to the CFM-29 hook discussed above, and smaller. BCF yarns generally must be expanded prior to use as loop material, typically by the application of heat. The yarn may be expanded prior to application to the carrier web, at the nip, or as a post-processing step after the yarn has been embedded. If the yarn is expanded at the nip, it may be necessary to minimize the nip pressure.

Figure 2:
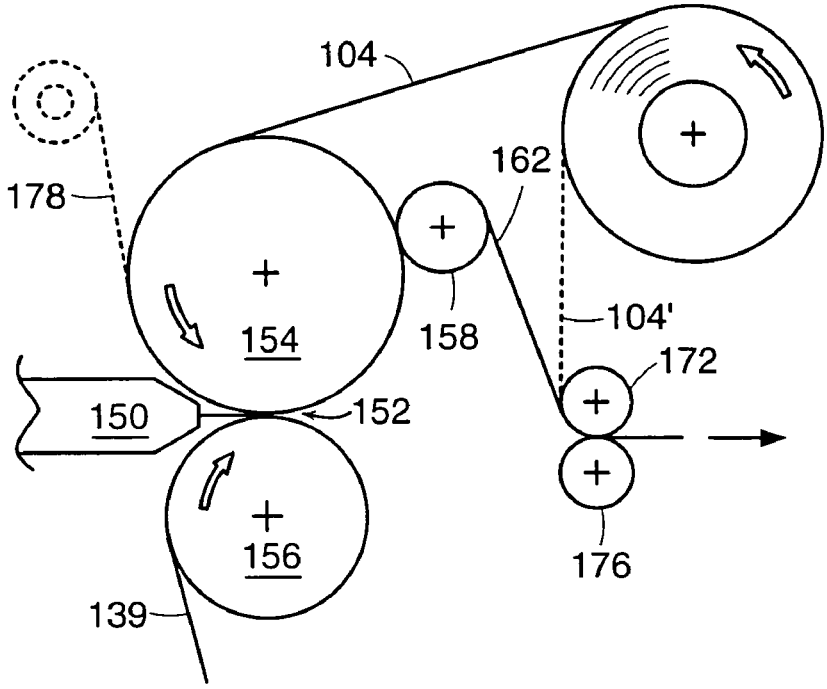
FIGS. 2 and 2A illustrate several methods for forming the closure strip of FIG. 1.

FIG. 2 illustrates an advantageous method and apparatus for producing the above-described closure strips. The method employs the continuous extrusion/roll-forming method for molding fastener elements on an integral, sheet-form base described by Fischer in U.S. Pat. No. 4,794,028, and the nip lamination process generally described by Kennedy, et al. in U.S. Pat. No. 5,260,015, the full disclosures of both of which are incorporated herein by reference. The relative position and size of the rolls and other components is not to scale. An extrusion head 150 supplies a continuous sheet of molten resin to a nip 152 between a cooled, rotating mold roll 154 and a counter-rotating pressure roll 156, Mold roll 154 contains an array of miniature, fastener element-shaped mold cavities extending inward from its periphery (indicated diagrammatically) for molding the fastener elements. Pressure in nip 152 forces resin into the fastener element cavities and forms the substrate. The formed product is cooled on the mold roll until the solidified fastener elements (e.g., hooks) are stripped from their fixed cavities by a stripper roll 158. Along with the molten resin, a continuous strand of yarn 104 is fed into nip 152, where it is only partially impregnated by resin and becomes permanently bonded to the front face of the substrate under cooled conditions that enable the outer fibers of the yarn to resiliently regain their loft and define hook-engageable loops upon emerging from the nip. Thus the product 162 that is stripped from the mold roll includes both fastener elements and engageable loops. For higher production rates, two or more widths of closure strip may be simultaneously produced on a single mold roll, and later split and spooled.

FIG. 2 also indicates other methods that in some instances may be employed to advantage. For instance, rather than introduce the yarn 104 through nip 152 and thereby join it to the substrate as the substrate is formed, the yarn may be joined to the substrate after the substrate has been formed, such as is indicated by the run 104' of yarn shown in dashed outline. In some cases, the front face of the formed substrate is heated in the region where the yarn will be applied, just before entering the nip between idlers 172 and 176. Paper 139 may be joined to the back face of the substrate by either running a strip of paper through nip 152 on the pressure roll side of the resin as indicated, or by adhering adhesive-coated paper to the formed substrate either at stripping roll 158 or at idler 176. For some applications, such adhesive-coated paper includes a transfer coating, such that its paper backing may be peeled from the adhesive on the back of the product to secure the back of the final product to a supporting surface. The adhesive applied to the back of the product in this manner may be either a pressure-sensitive or heat-activated adhesive, for instance. For decreasing the air or moisture permeability of the final product, a second flow of resin (either molten or in the form of a film; not shown) may be added to the nip against pressure roll 156 to form a backing on the final product. For instance, a layer of polyester may be added to reduce the oxygen permeability of a polyethylene closure strip, arid/or oriented polypropylene or high density polyethylene may be added as a moisture barrier. These additional layers are often used for packaging certain foods. Adding a strip of barrier material 178 between the yarn and the molten resin optionally controls the pattern of penetration of resin into the yarn in nip 152.

Barrier material 178 is, in some instances, a perforated paper or film that allows resin to pass into the yarn in selected regions but inhibits its flow into other regions. The barrier material may also be a homogeneous sheet of material having a high porosity, limiting the penetration of resin into the yarn.

Figure 3A:
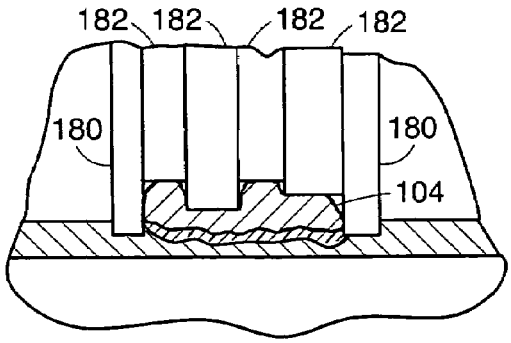
FIGS. 3A and 3B are enlarged transverse views of alternate embodiments of the forming nip of the apparatus of FIG. 2, showing the yarn loop component being partially embedded in resin of the closure strip.
Figure 3B:
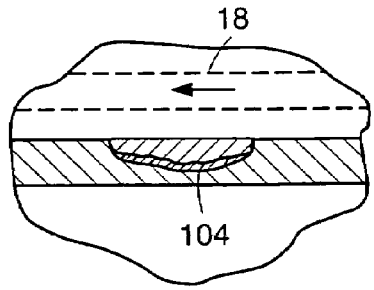

FIG. 3 illustrates the bonding of the yarn 104 to the resin of the substrate in nip 152 (FIG. 2). Mold roll 154 includes "guide" rings 180 on either side of a set of reduced diameter rings 182, forming a groove that helps to keep the yarn transversely located along the nip. Rings 182 may be of a single, reduced diameter or, as shown, may have outer diameters that undulate to produce regions of varying lamination pressure between the yarn and resin, such as the staking rings taught in our prior applications incorporated by reference above. If multiple strands of yarn are to be introduced to the resin along separate paths, the mold roll is provided with a corresponding number of grooves formed by appropriate, reduced diameter rings. We have also surprisingly found that yarn 104 may, in some cases, be successfully attached to the resin without any corresponding features on the mold roll, even at normal hook-molding nip pressures, as shown in FIG. 3B. Even though the yarn bulk is, in either case, greatly compressed in the molding/encapsulating nip, it has been found to quickly regain significant loft and bulk upon exiting the nip, as shown in FIG. 1B. for example. A cooling channel 183 is shown near the surface of the molding roll on the side of the nip nearest yarn 104, to help moderate the temperature of the outer side of the high loft yarn to enhance the amount of the yarn that remains clean of the molten plastic. Mold rolls with such cooling passages are more fully described in U.S. Pat. No. 6,039,556, the disclosure of which is hereby incorporated by reference.

Figure 2A:
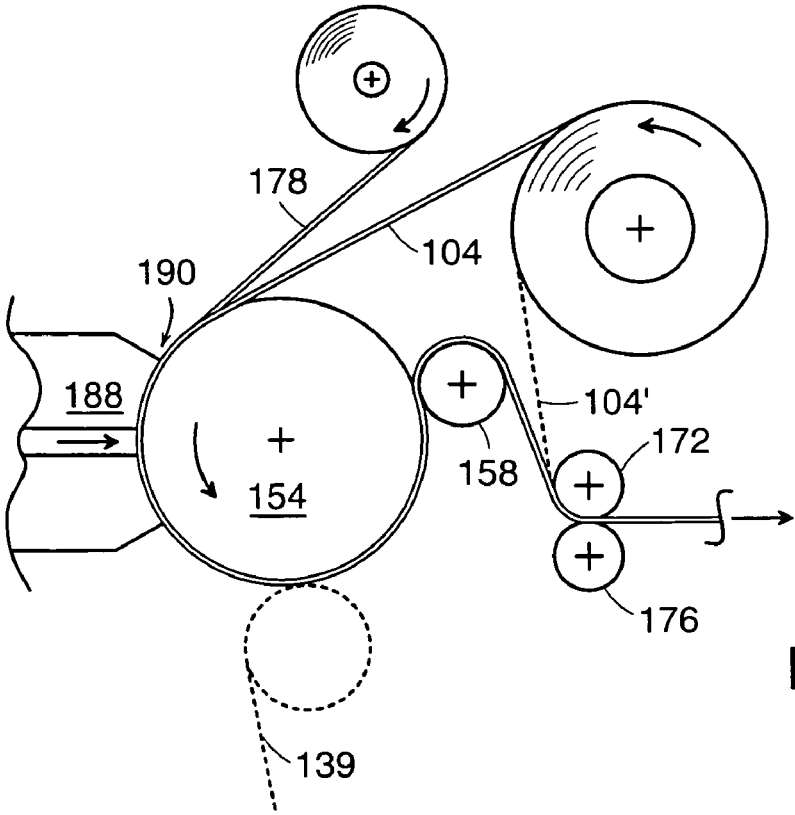

FIG. 2A illustrates an alternative method and apparatus for forming the above-described closure strips. The contoured surface of an extrusion head 188 (sometimes called an injection head) is placed adjacent a mold roll 154 (with fixed fastener element molding cavities as described above with respect to FIG. 2), and a continuous flow of molten resin is injected under pressure into the gap 190 defined between head 188 and mold roll 154, filling the fastener element cavities and forming the front and back faces of the substrate. The configuration and construction of mold roll 154 is the same as is shown in FIGS. 3A or 3B, in which the lower molding member may be taken to be the adjoining extrusion head. Yarn 104 is fed through a predetermined region of gap 190, and held against the surface of mold roll 154 by resin pressure in the gap. In this manner, the loop material is partially impregnated with substrate resin and permanently bonded to the front face of the substrate. In some applications where it is not possible to fill the fastener element cavities without completely saturating the yarn with resin, a strip of barrier material 178 is fed through gap 190 between head 188 and loop material 160. Barrier material 178 is discussed in more detail above with respect to FIG. 2, For some applications a strip of paper or other suitable backing material 139 is laminated to the back face of the substrate while the molded product is retained on mold roll 154, by pressure supplied by a pressure roll, for example. Alternatively, a strip of adhesive-coated paper may be adhered to the formed substrate either at stripping roll 158 or at idler 176.

Figure 4A:
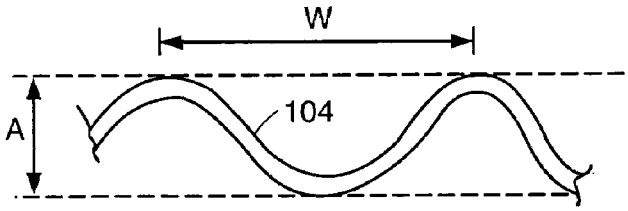
FIGS. 4A-4C show undulating yarn loop component patterns.
Figure 4B:
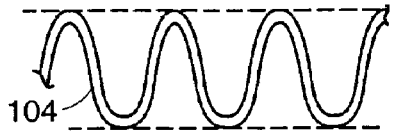
Figure 4C:
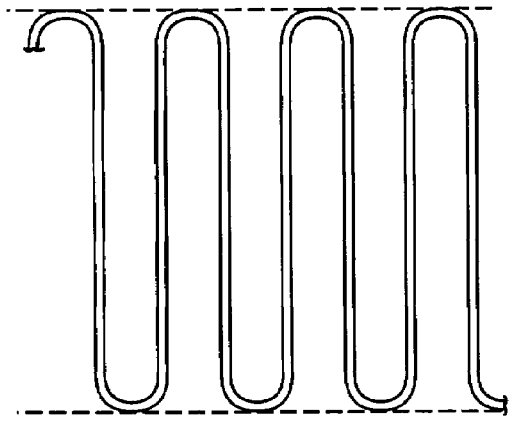

Referring to FIGS. 4A and 4B, yarn 104 may be arranged within the loop band of the closure, upon the face of the carrier strip, in an undulating or oscillating pattern having wavelength 'W' and amplitude 'A'. both parameters W and A being variable over wide limits to produce the coverage appropriate to the closure application at hand. The resulting loop band has more loops per unit closure length than with a single longitudinal strand of yarn, and these loops are spread out over a greater width to facilitate engagement or further reduce the need for closure alignment. In addition, bending the helically wound yarn strand near the edges of the loop band can act to locally open the twisted helix and provide even greater loft and interstitial area for hook penetration. This effect becomes even more pronounced as the wavelength of the pattern decreases and the localized curvature of the yarn increases, such as in the pattern of FIG. 4B. Although the yarn extends generally along the length of the closure, these patterns produce segments, near the center of the loop strip, that locally extend in different directions. The amplitude of the pattern in some cases is much larger, as shown in FIG. 4C, such that the center segments are practically transverse to the machine direction and the yarn forms a loop field of broad area. The pattern may resemble, for example, a sine wave, square wave, triangular wave, or other waveform. One advantage of employing yarns for such constructions is that the nature of most yarn is such that engageable fibers extend from all sides of the yarn rather than from a single broad surface as in many woven or needled loop components. Thus, where such directional components could be split into narrow widths and then arranged in an undulating pattern, yarns avoid any concern regarding maintaining any side of the yarn strand facing upward for engagement. In that sense, most twisted yarns can be said to be omni-directional loop members.

Figure 5:
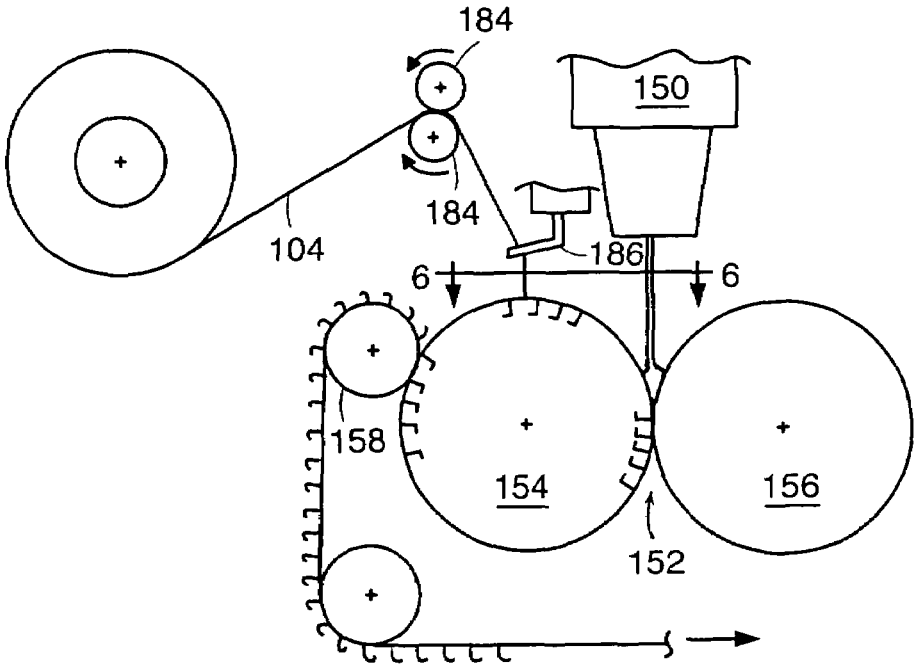
FIG. 5 illustrates a method and apparatus for forming the closure strip with a yarn loop component having an undulating pattern and encapsulated in the closure substrate as the closure substrate is formed.
Figure 5A:
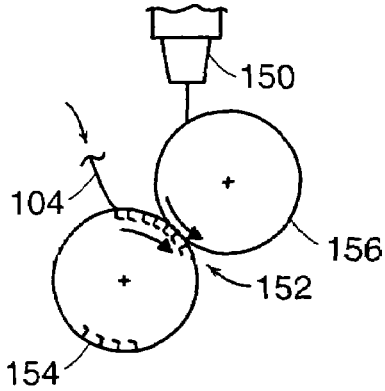
FIG. 5A shows a variation of the nip arrangement of the machine of FIG. 5.
Figure 6:
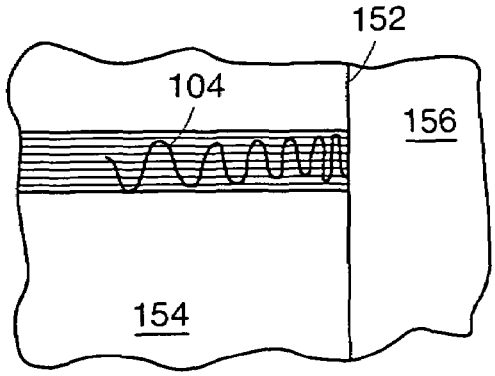
FIG. 6 is a cross-sectional view taken along line 6-6 in FIG. 5.

FIG. 5 shows one method of patterning yarn 104 as it is applied while molding the male fastening elements of the closure. The method shown employs a mold roll 154, pressure roll 156, stripping roll 158 and extruder 150 of similar construction to those described above, but with the mold and pressure rolls arranged side-by-side and the extruder above the nip 152 between the rolls. The resin is gravity-fed toward the nip, but otherwise subjected to the same nip pressures and temperatures as in the above-described processes. The feed rate of yarn 104 is maintained by drive rollers 184 and selected in accordance with the speed of mold roll 154 and the amplitude and frequency of the intended yarn pattern. The yarn is fed through an eye at the end of an oscillating arm 186 adapted to move back and forth at a frequency and amplitude corresponding to the desired pattern, laying yarn 104 upon the region of mold roll 154 associated with the loop band of the finished product, as shown in FIG. 6. To help retain yarn 104 in its as-laid configuration as it travels with the surface of mold roll 154 into nip 152, the loop band section of the mold roll may be equipped with a rough surface finish or very small pins or other protrusions (not shown), such that the yarn does not slide across the roll surface. The staggered profiles of multiple staking rings can also help prevent slippage. For some yarn types and weights, or in instances where a smooth mold roll loop band section surface is desired, the arrangement of mold and pressure rolls 154 and 156 may be configured as shown in FIG. 5A, with the resin introduced to pressure roll 156 ahead of nip 152, either by extruder 150 as shown, or by a pressure head similar to that of FIG. 2A. The configuration of FIG. 5A reduces the maximum vertical slope encountered by yarn 104 on mold roll 154 before being introduced to the molten resin at the nip.

Figure 7:
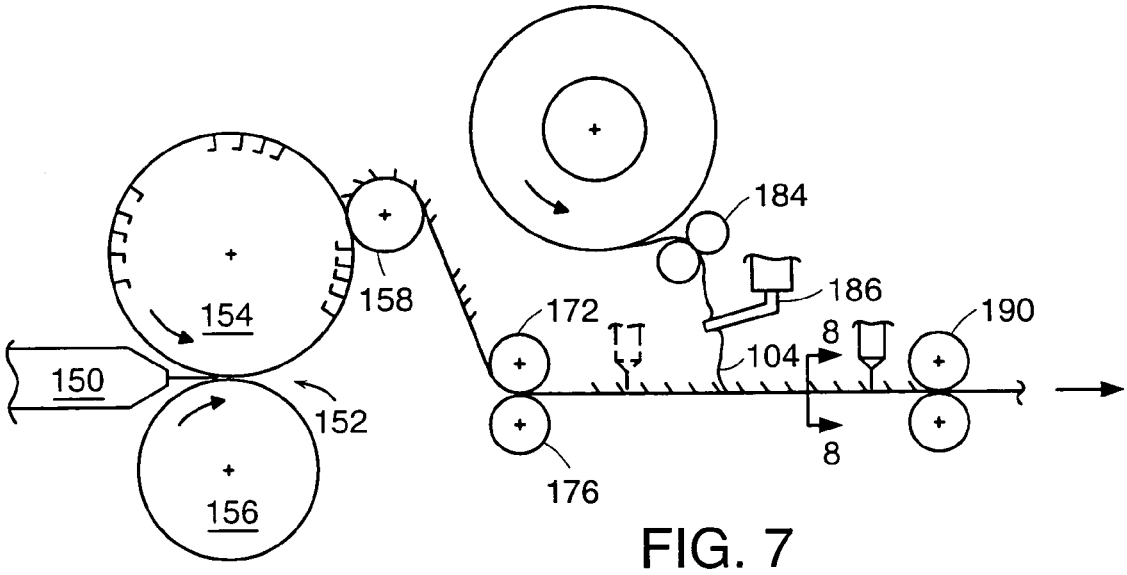
FIG. 7 shows a method and apparatus for applying a yarn loop strip in an undulating pattern to a closure strip after the closure strip fastener elements and base are formed.
Figure 8:
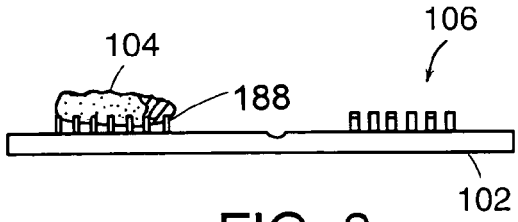
FIG. 8 is a cross-sectional view taken along line 8-8 in FIG. 7.

Alternatively, yarn 104 may be attached to the substrate of the closure downstream of the molding nip, as illustrated in FIGS. 7 and 8. In this example, the substrate and hooks are formed in nip 152 as described above, but mold roll 154 is further equipped with mold rings configured to form an array of straight stems 188, as seen in FIG. 8. After this molded product is stripped from roll 154 by roll 158 and travels between rolls 172 and 176, yarn 104 is paid out onto the molded stems 188 in either a straight line in the machine direction or in a pattern having a cross-machine component, such as those shown in FIGS. 4A-4C. Stems 188 temporarily secure yarn 104 in place until the ends of the stems are melted to encapsulate the lower, snagged fibers of the yarn. The ends of the stems may be melted by passing the yarn and stems under a heated roller 190 having a surface temperature above the melting point of the stem resin but below the melting point of the resin of the yarn. Flame softening of the stem tips, as illustrated by flame heater 192, is useful for some combinations of stem and yarn resins, with care being taken to ensure that the yarn filaments intended to remain exposed for engagement are not also melted. Alternative, as indicated in dashed outline, flame or other softening of the resin may occur just prior to laying down the yarn. As an alternative to stems, a second band of male fastener elements, such as J-hooks, may be molded in nip 152 along the region of the substrate to carry the yarn, and subsequently melted to encapsulate the yarn fibers.

Figure 9:
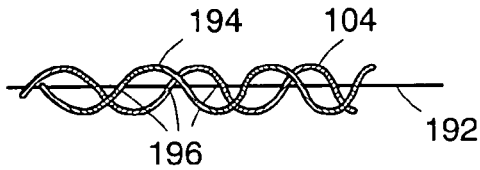
FIG. 9 shows two yarn strands laid in a staggered sinusoidal pattern across a bead of molten resin on a closure strip to form a loop component.

Although encapsulation in resin of the molded substrate is preferred for attaching yarn 104, other means are also contemplated, such as securing the yarn with an adhesive or by staking the yarn into a bead of resin (such as, for instance, hot melt glue) applied to the molded substrate before the yarn is introduced. The attachment means must be sufficiently secure to withstand anticipated peel and shear loads encountered by the yarn in use in the closure but, as already stated, for many disposable packaging applications the anticipated loads and closure cycles are relatively low. FIG. 9, for example, shows a strand of yarn 104 and a strand of yarn 194 laid in a sinusoidal pattern over a bead 192 of molten polyethylene. Bead 192 and the yarn strands then run through a nip as necessary to encapsulate fibers of the yarn in resin of the bead at nodes 196 before the bead solidifies. Because the strands are only attached at spaced-apart nodes 196, they define arcuate portions between the nodes that are either free of encapsulation or more lightly encapsulated than at nodes 196.

There is advantage to leaving the molded resin base of the closure in an as-molded state (i.e., without any post-attachment stretch or orientation) to avoid, for example, pulling any of the encapsulated fibers of the yarns from the resin of the base and thereby weakening the yarn attachment. Stretching can tend to fail or detach the tautest fibers first, and because of normal post-stretching relaxation of the base resin, can result in a lack of desirably taut, encapsulated fibers in the final product. However, for certain applications with the yarn 104 laid in an undulating or sinusoidal pattern having portions that extend at an angle to the machine or forming direction of the closure, there may be some advantage in stretching the product in the machine direction after the yarn is attached. It is believed that such stretching may help to expand the width of these angled portions of yarn, tautening some of the exposed fibers and improving the load-carrying capacity of the closure. Such stretching can be accomplished before the molded product is spooled at the end of the forming line, such as by overrunning stripping roller 158 in FIG. 5 if the yarn is attached in the nip, or by placing a multi-stage longitudinal stretching station (not shown) downstream. When using such a hot can downstream stretching station, the heated cans should be arranged to not load directly against the working surface of the closure so as to not damage the male fastener elements.

Figure 10:
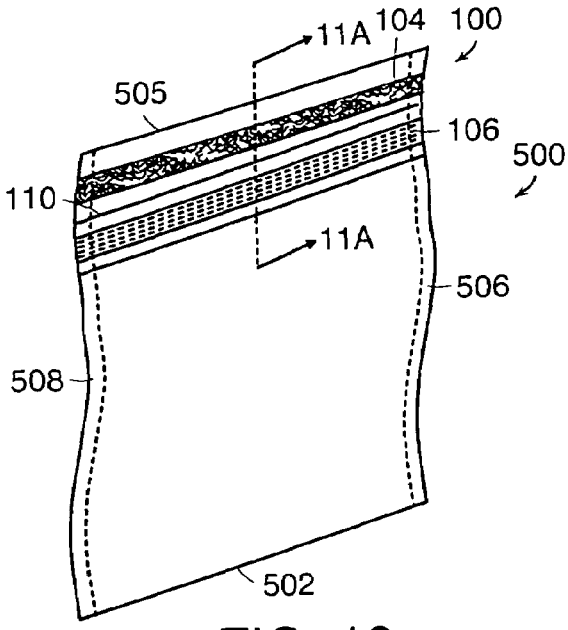
FIG. 10 shows a disposable, flexible bag incorporating the closure strip of FIG. 1.

FIG. 10 shows a disposable packaging application employing the above-described closure. Bag 500 consists of a piece of polyethylene bag material folded once to form the bottom edge 502 of the bag, joined to a closure 100 to form the upper edge 505 of the bag, and permanently sealed along the remaining two sides 506 and 508 by welding the material of the front face of the bag to the material of the back face of the bag. Although illustrated as a flat bag, bag 500 may be constructed in other forms, such as a pouch with a lower pleated end for standing the pouch upright on its lower edge.

Figure 12:
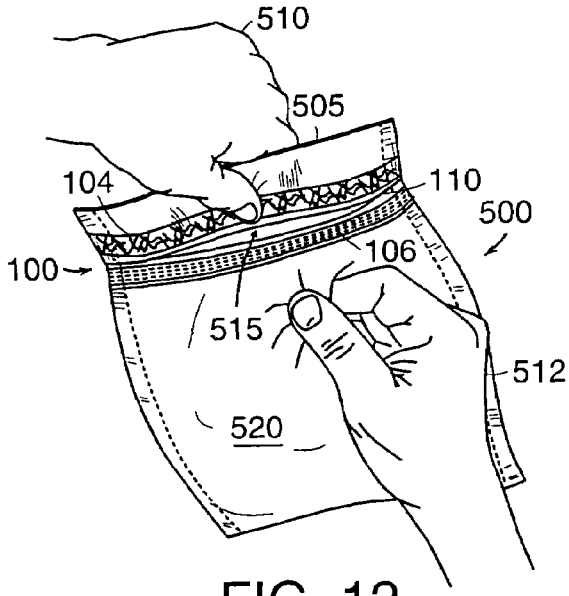
FIG. 12 illustrates a method of opening the bag of FIG. 10.

Referring to FIG. 12, to initially open the sealed bag, the upper edge 502 is grasped in one hand 510 and the front face of the bag is grasped in the other hand 512, on either side of a frangible channel 110 integrally molded to extend along closure 100 (see also FIG. 1). By only grasping or pinching the front face of the bag with hand 512, and not the back face of the bag, pulling the front face of the baa away from the upper edge places a high tensile load across channel 110, propagating a tear along channel 110 that creates an opening 515 into the bag.

Figure 11A:
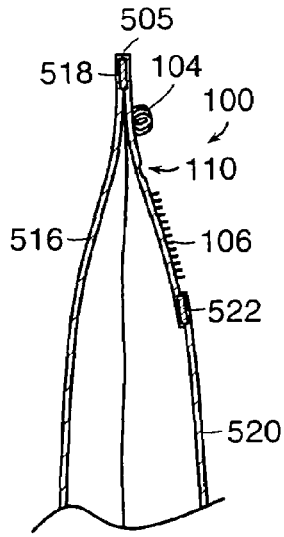
FIGS. 11A and 11B are cross-sectional views taken along line 11A-11A of FIG. 10 with the bag as originally sealed, and as reclosed, respectively.

As shown in FIG. 11A, the bag material of the back side 516 of the bag is welded to the back (i.e., non-fastening) side of the reclosable closure 100 at 518. The bag material of the front side 520 of the baa is welded to the closure along an edge region 522 of the front (i.e., fastening) side of the closure 100. With the closure so attached to the bag material, and sealed along the sides of the bag (see FIG. 10), the closure provides an airtight, liquid-tight seal at one end of the bag.

Figure 11B:
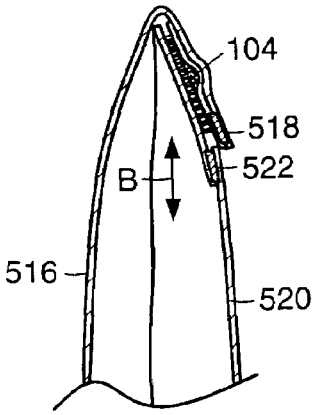

The front face of closure 100 carries yarn 104 partially embedded within the base resin of the closure, and a strip 106 of hook-shaped fastener elements molded out of resin of the base in rows extending along the length of the closure. After being initially opened by pulling apart the closure along groove 110, the bag may be reclosed by folding its upper edge about the opening created by tearing the closure, releasably engaging the yarn 104 with the strip 106 of hooks (FIG. 11B). In this closed state, it will be understood from FIG. 11B that loads parallel to arrow "B" caused, for example, by shifting bag contents loading up against the closure end of the bag, will load the closure primarily in shear rather than as normal or separation loads. Further, given that both the bag film and the closure substrate are extremely flexible, almost all incidental loads will, after resulting deflections of the baa film, be translated into shear loads across the closure. The yarn-loop structures of the closures described above are particularly well suited to this type of application in which the incidental peel and separation loads are minimal.

Figure 13:
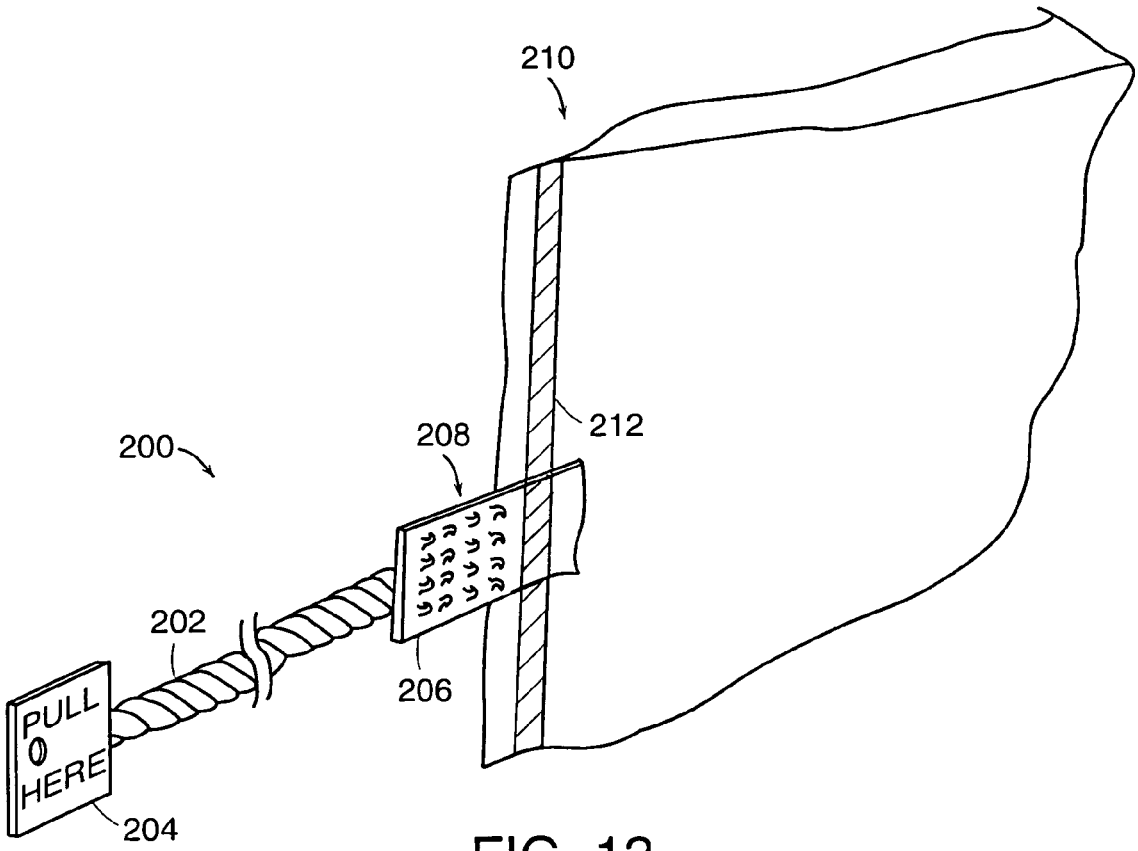
FIG. 13 illustrates a wrap tie closure incorporating a yarn loop component.
Figure 13A:
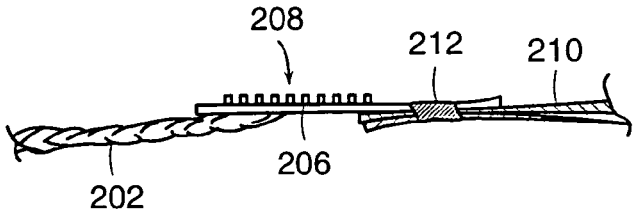
FIG. 13A is a cross-sectional view taken along line 13A-13A in FIG. 13.

FIGS. 13 and 13A illustrate another example of a disposable packaging application employing a releasable enclosure 200 having a freely-extending strand of yarn 202 adapted to serve as the loop component for a hook-and-loop type fastening. The closure in this embodiment consists of a single strand of yarn 202 extending between a pull tab 204 and a hook tab 206 with an array of integrally molded male fastener elements 208. One end of hook tab 206 is permanently attached to disposable polyethylene baa 210 along one of its sides, such as by incorporation in a side heat seal 212 as shown, or by pressure sensitive adhesive. The bag may be, for instance, of the type displayed for customer use in a produce section of a grocery store. If desired, two to four yarns 202 may be provided in parallel, although one yarn is sufficient for many applications.

Figure 14:
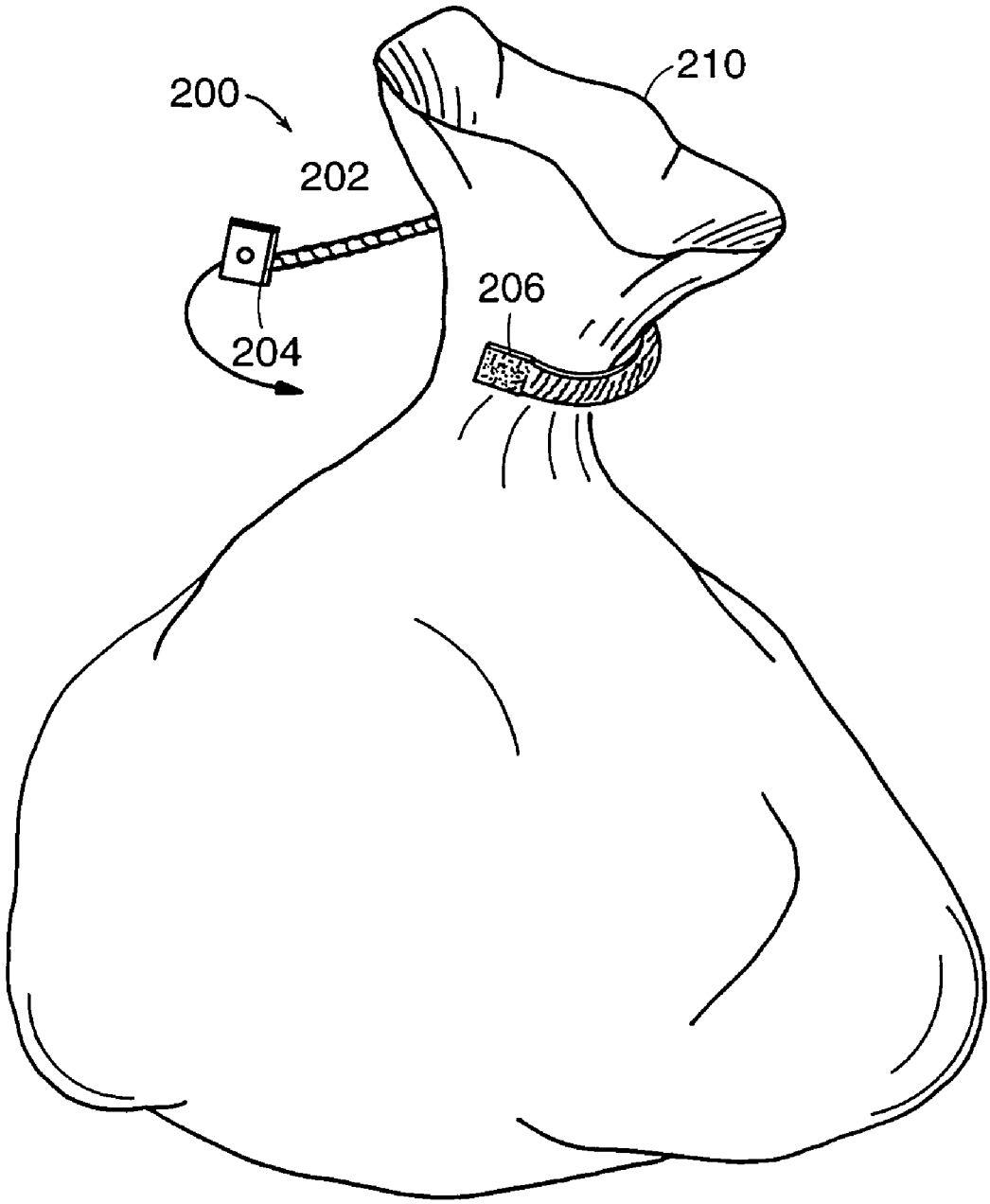
FIG. 14 shows a disposable bag being secured with the wrap tie closure of FIG. 13.

FIG. 14 shows how closure 200 is employed as a wrap tie about the top of bag 210. With product in the bag, the bag is suspended from its upper edge region (i.e., the area above closure 200) with one hand, while pull tab 204 is grasped in the other hand and yarn 202 is wrapped about the neck of the bag and engaged upon the male fastener members of hook tab 206, drawing the top of the bag closed. Advantageously, hook tab 206 can be engaged anywhere along the length of yarn 202. The only alignment required for closure is that some portion of yarn 202 extend across hook tab 206. Even slight resiliency in the collapsed neck of the bag or in yarn 202 will help maintain tension in the wrapped yarn and some beneficial shear load between the engaged hooks and yarn fibers. Ideally, the yarn is of a length permitting multiple passes about the collapsed bag neck and thus multiple chances of crossing the hook tab. Pull tab 204 is provided as an aid in grasping the free end of yarn 202, but the closure will suitably function to retain the bag opening closed without any such tab.

Although closure 200 is illustrated as attached to bag 210 along a side seal, it may be readily attached at any point on the outer surface of the bag, although for closing the open end of the bag it should be attached suitably near the open bag end. If desired, the entire back face of hook tab 206 can be adhered to the bag film rather than one end, although for some applications we have found that the working face of the hook tab is less likely to become covered by the collapsing bag film if only an end opposite the end attached to yarn 202 is secured, as shown.

Figure 15:
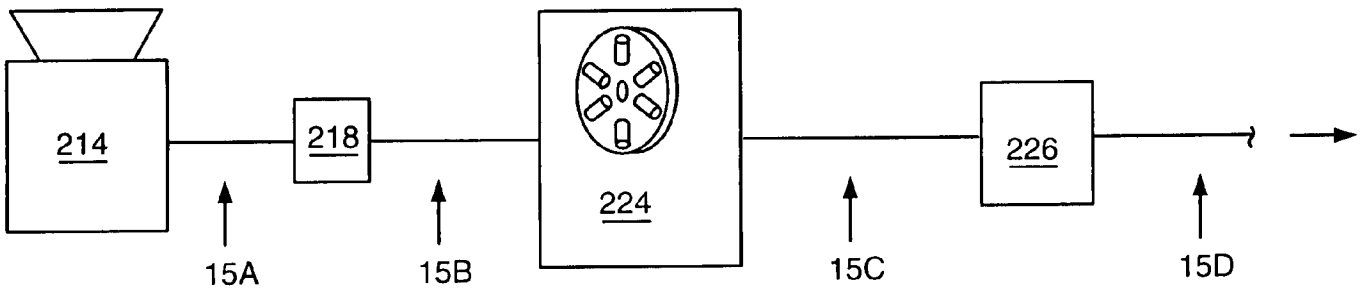
FIG. 15 illustrates a process for making wrap tie closures in a continuous process.
Figure 15D:
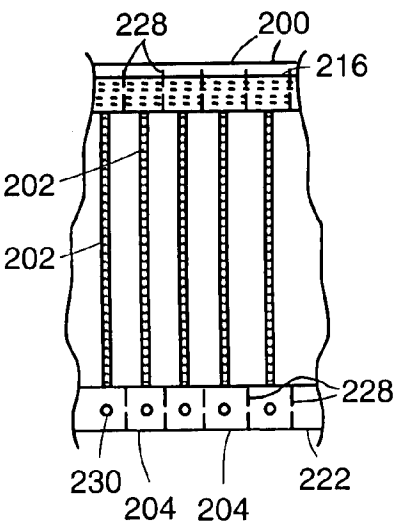
FIGS. 15A-15D show the product being processed at respective points along FIG. 15.
Figure 15C:
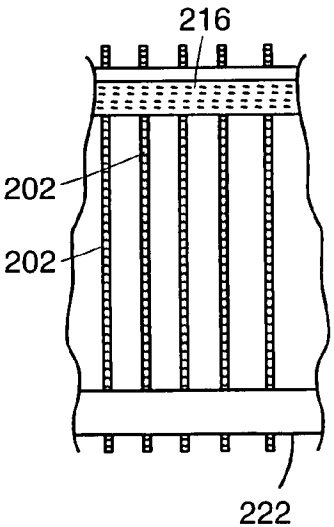
Figure 15B:
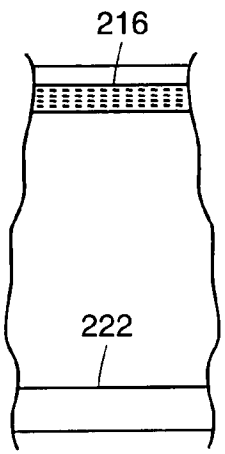
Figure 15A:
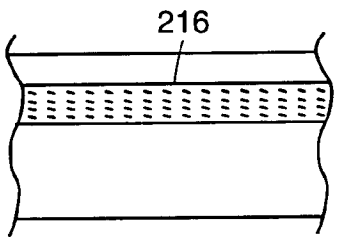

Referring to FIG. 15, a continuous process for making wrap tie closures such as the closure 200 of FIG. 13 includes a Fisher-type continuous forming method (CFM) machine 214 that takes raw resin and produces a continuous strip-form fastener tape 201 having an array of integrally molded hook-type fastener elements formed on one side of the tape in a discrete band 216 (FIG. 15A). From there, the fastener tape is longitudinally split by a slitting station 218 into a hook portion 220 that contains the fastener elements and a spaced-apart strip 222 of smooth resin (FIG. 15B). These two continuous tapes are simultaneously fed into a combiner 224 that lays discrete lengths of yarn 202 across the two tapes (FIG. 15C). These yarn lengths may be temporarily retained on the upper (i.e., back) surfaces of the tapes by first applying a light adhesive to the tapes, or by flame-softening the back tape surfaces to produce a light tackiness for holding the yarns in place as the tapes progress to a finishing station 226. At station 226 the yarn lengths are permanently attached to both strips, such as by heat staking or other means, and the two strips are die cut to provide tear lines 228 defining individual hook tabs 206 and tear tabs 204 (FIG. 15D) and any other desired features, such as tractor feed holes 230 (shown only on one side for illustration only) for later processing, and to trim the outer edges of the tabs and yarns. Finishing station may also be equipped to apply adhesive and a release paper to the back side of hook tabs 206, for securing the individual wrap ties to packages, or to print appropriate instructions or indicia on pull tabs 204. As an alternative to molded pull tabs 204, paper pull tabs may be formed from a strip of paper to which one end of each yarn length is attached.

Figure 16:
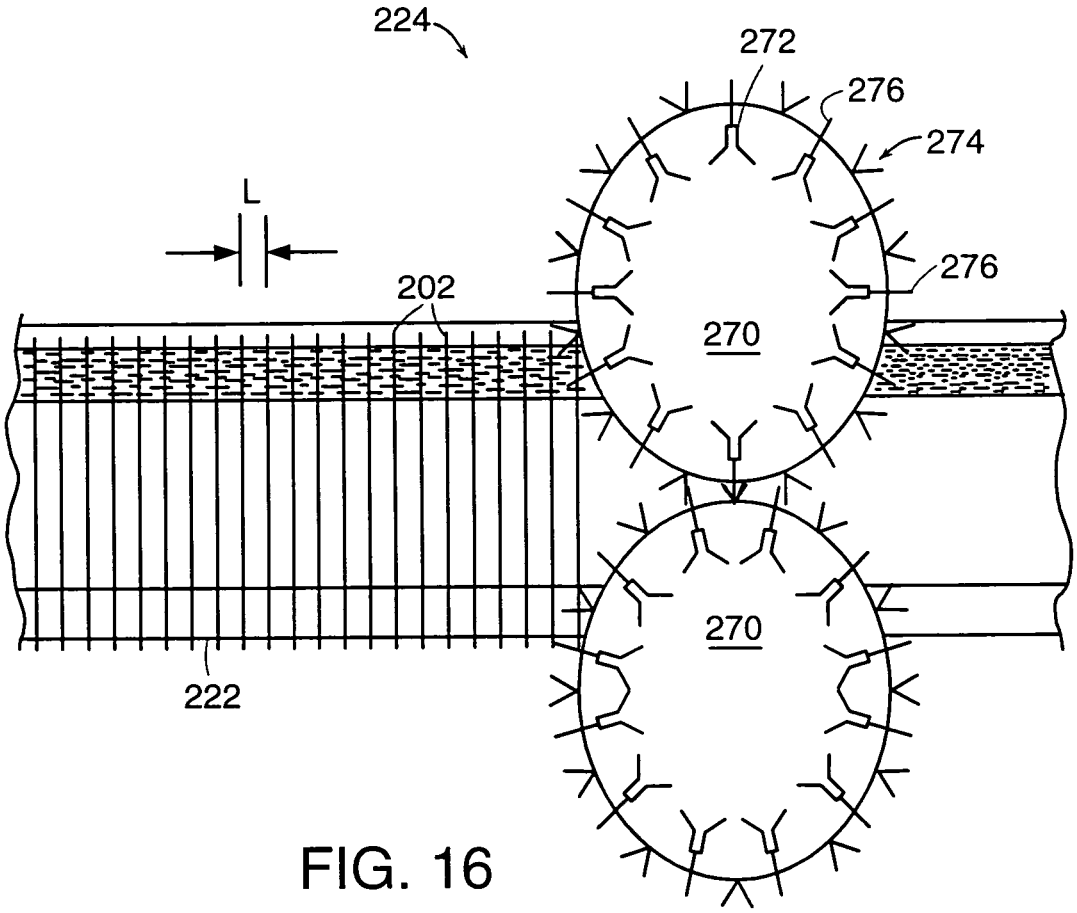
FIGS. 16 and 16A are illustrative plan and side views, respectively, of the function and basic structure of the combiner of FIG. 15.
Figure 16A:
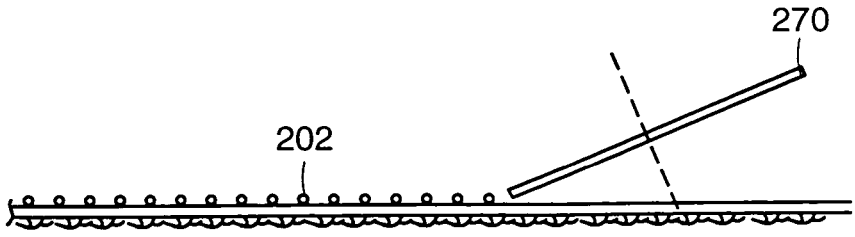

As illustrated in FIGS. 16 and 16A, combiner 224 may be of the rotary wheel type of machine employed to lay glass fiber onto moisture sensitive kraft paper in the production of reinforced packing tape, for example, with two skewed wheels 270, each containing multiple (e.g., twelve) yarn bobbins 272. When rotating together, the two bobbin wheels 270 can be configured to lay and cut yarn lengths with the proper spacing "L", such as 0.25 inch, required for the closures. As the bobbin wheels rotate, yarn ends 276 extending from the bobbins are grasped and pulled by grippers 274 of the other wheel, extending the yarns and laying them against the preform resin strips, on the side of the hook strip opposite the molded hooks. At full extension, yarns are severed from the bobbin supply by cam driven cutters.

Alternatively, the yarn may be supplied as part of a scrim having only weft yarns extending across a wide middle region but connected along the edges by a few warp yarns. Such a scrim may be produced, for example, by the "SCRIMASTER" process developed by Nashua Industrial Machine Corp. The scrim is similarly laid across the two resin strips with the weft yarns extending between them, and the rest of the process is as illustrated.

Combiner 224 may also be used to apply yarns onto the surface a softened carrier web, to form a loop tape having yarns extending in the cross-machine direction.

Figure 17:
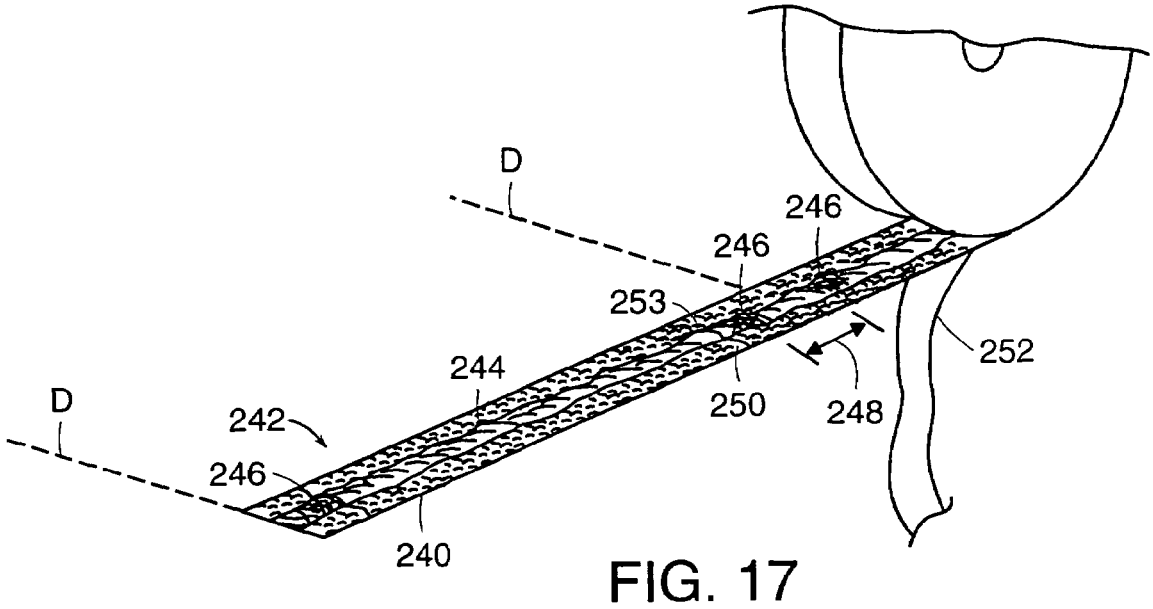
FIG. 17 shows a closure strip being attached to an edge of a bag.

Referring now to FIG. 17, another closure strip employing a yarn strand as a loop member consists of a resin substrate 240 molded to have an array of male fastener elements 242 extending from and across its upper surface. The back surface of the substrate carries a pressure sensitive adhesive across its entire length except over a short span 248 associated with each pull tab segment 253 (to be discussed below) and a continuous release paper 252 over the adhesive. The adhesive and release paper are readily applied after the substrate is molded with the fastener elements. A single yarn strand 244 extends along the length of the strip, and is permanently secured to the substrate at fixed intervals in narrow bands 246, such as by heat staking. Besides being snared upon the fastener elements, yarn 244 remains unattached along the spans between bands 246. Substrate 240 (but not yarn 244) is perforated across its width at line 250, thereby defining one edge of a pull tab extending along span 248. In use, the pull tab is adapted to be torn from the rest of the substrate and pulled to extend a free length of yarn 244 that remains attached to the substrate only at its opposite end at an associated band 246.

By removing release paper 252, the adhesive is employed to attach the closure strip vertically to a series of bags being formed from bag film (e.g., to one of the closed side edges of the bags), with the film and closure strip eventually cut along lines "D" to form individual bags, each having a length of closure strip extending along one side edge. Because the adhesive was omitted from spans 248 adjacent one end of each bag, pull tab 252 may be easily grasped and torn from the rest of the closure strip by an end user, extending yarn 244 to be wrapped snugly about the bag and secured upon the hook elements of the face of the closure substrate to secure the once-opened bag. Again, the yarn can be wrapped numerous times around the bag and to a selected region of the vertically-extending hook strip at each pass. Thus, even a helical tight wrapping along the entire length of the bag can be achieved.

Figure 18:
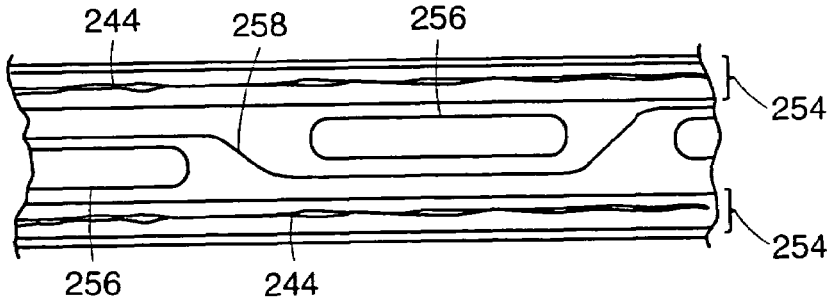
FIG. 18 shows a twin closure strip configuration.

FIG. 18 illustrates that two strips of closures can be produced from a single length of product appropriately provided with two bands 254 of hook elements and two corresponding strands of yarn 244. In addition, the product can be die cut to provide holes 256 that serve as handles in the finished bags, with the closure strips separated along die cut line 258.

A number of embodiments of the present invention have been described. Nevertheless, it will be understood that various modifications may be made without departing from the spirit and scope of the invention. Accordingly, other embodiments are within the scope of the following claims.

For example, the yarns may be arranged in a number of configurations other than those shown and described above. A few examples of alternate arrangements are shown in FIGS. 19-21.

Figure 19:
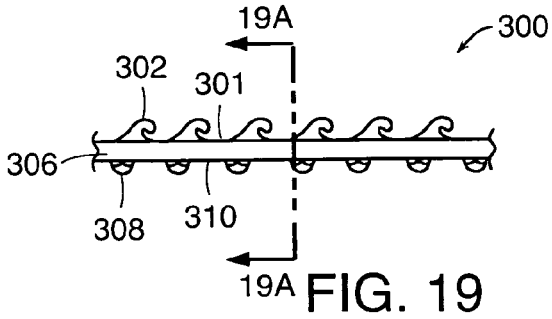
FIG. 19 shows a side view of a fastener product having yarns on one side and hooks on the opposite side.
Figure 19A:
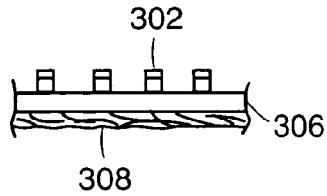
FIG. 19A is a cross-sectional view of the product of FIG. 19, taken along line A-A.

Fastener product 300, shown in FIG. 19, includes a plurality of hooks 302, arranged on a first surface 304 of the carrier sheet 306, and a plurality of yarns 308 arranged on the opposite surface 310 of the carrier sheet 306. In the embodiment shown in FIG. 19, the yarns extend in the cross-machine direction, rendering the product suitable for use, e.g., as a self-engaging tie strap. The yarns may be applied in this manner using the combiner discussed above. Alternatively, if desired, the yarns may extend in the machine direction.

Figure 20:
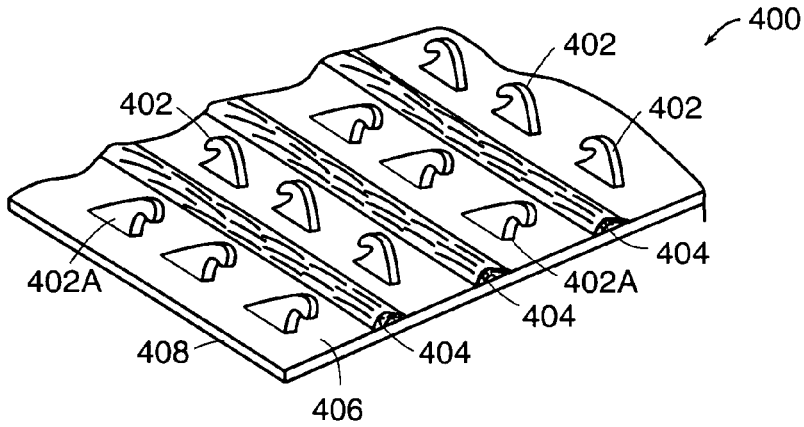
FIG. 20 is a perspective view of a fastener product including an alternating arrangement of yarns and rows of hooks.

Fastener product 400, shown in FIG. 20, includes a plurality of hooks arranged in rows in which the hooks face in a first direction, and a plurality of hooks 402A, arranged in rows in which the hooks face in the opposite direction. A yarn 404 is disposed between each of the rows of hooks. Both the hooks and the yarns are disposed on the same surface 406 of the carrier sheet 408.

Figure 21:
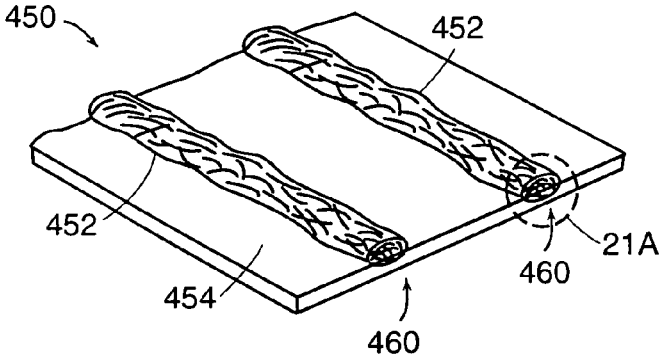
FIG. 21 is a perspective view of a fastener product including a plurality of substantially parallel yarns.
Figure 21A:
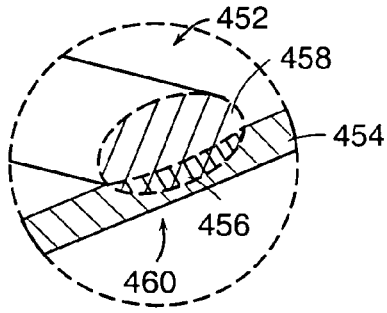
FIG. 21A is a highly enlarged perspective view of detail A in FIG. 21.

Fastener product 450, shown in FIG. 21, includes a plurality of spaced, parallel yarns 452, disposed on a carrier sheet 454. As discussed above, yarns 452 are partially embedded (embedded region 456, FIG. 21A) in the carrier sheet 454, with most of the yarn (portion 458, FIG. 21A) being free for engagement with loops. The areas 460 of the carrier sheet in which the yarns are partially embedded are substantially planar.

Suitable yarns include, in addition to those discussed above, flat braids of a construction similar to shoelace material.

The yarns may be subjected to post processing (e.g., after being embedded in the carrier film) to improve bulkiness and loft of the yarn. This may be appropriate, for example, if the yarn has been compressed by high nip pressure. Suitable post processes include napping and brushing.

Like reference numbers and designations in the various drawings indicate like elements.

What is claimed is:

1. A hook-engageable fastener material for a hook and loop fastening system comprising a carrier in the form of a sheet of flexible material and at least one high bulk yarn extending along the carrier and intimately secured substantially continuously along its length to a portion of the carrier, the high bulk yarn having a structure comprised of a multiple, twisted-together plies, each ply being formed of fibers or filaments that have been textured.

2. The hook-engageable fastener material of claim 1 wherein the portion of the carrier to which the yarn is secured is substantially planar.

3. The hook-engageable fastener material of claim 1 wherein the portion of the carrier to which the yarn is secured has a thickness of less than about 0.010 inch.

4. The hook-engageable fastener material of claim 1 wherein the texturized fibers comprise crimped fibers.

5. The hook-engageable fastener material of claim 1 wherein the yarn has a bulk ratio of from about 15 to 50.

6. The hook-engageable fastener material of claim 5 wherein the yarn has a bulk ratio of from about 18 to 40.

7. The hook-engageable fastener material of claim 1 wherein the yarn is selected from the group consisting of yarns formed of acrylics, nylons, polyesters, polypropylenes, natural fibers and blends thereof, and bulk continuous fiber yarns.

8. The hook-engageable fastener material of claim 1 further comprising an array of hook elements integrally molded with the carrier and extending therefrom.

9. The hook-engageable fastener material of claim 8 wherein the hook elements extend from the surface of the carrier to which the yarn is secured.

10. The hook-engageable fastener material of claim 8 wherein the hook elements extend from a surface of the carrier opposite to the surface to which the yarn is secured.

11. The hook-engageable fastener material of claim 8 wherein the hook elements have a height of 0.015 inch or less.

12. The hook-engageable fastener material of claim 8 or 11 wherein the hook elements are arranged in an array with a density of between about 500 and 3000 hooks per square inch.

13. The hook-engageable fastener material of claim 1 wherein the yarn extends linearly along the carrier.

14. The hook-engageable fastener material of claim 1 wherein the yarn is disposed on the carrier in a reciprocating pattern.

15. The hook-engageable fastener material of claim 1 wherein the reciprocating pattern comprises a sinusoidal pattern.

16. The hook-engageable fastener material of claim 1 comprising a plurality of yarns.

17. The hook-engageable fastener material of claim 16 wherein said yarns are separate and are connected only by mutual attachment to the carrier.

18. The hook-engageable fastener material of claim 16 wherein said carrier is elongated, and the yarns extend perpendicular to the length of the carrier.

19. The hook-engageable fastener material of claim 16 or 18 wherein said yarns are substantially parallel to each other.

20. The hook-engageable fastener material of claim 19 further comprising rows of hooks interposed between the parallel yarns.

* * * * *

UNITED STATES PATENT AND TRADEMARK OFFICE

CERTIFICATE OF CORRECTION

PATENT NO. : 7,395,583 B2
APPLICATION NO. : 10/300532
DATED : July 8, 2008
INVENTOR(S) : Clune et al.

It is certified that error appears in the above-identified patent and that said Letters Patent is hereby corrected as shown below:

Title page Item (73) "Valero Industries B.V." should be --Velcro Industries B.V.--

Signed and Sealed this

Sixteenth Day of December, 2008

JON W. DUDAS
*Director of the United States Patent and Trademark Office*